United States Patent [19]

Brown et al.

[11] 4,368,020

[45] Jan. 11, 1983

[54] MOLD BOX WEDGING ASSEMBLY

[75] Inventors: Leonard Brown, Levittown; Guenter R. Goebel, Grampian, both of Pa.

[73] Assignee: Crossley Machine Company, Inc., Trenton, N.J.

[21] Appl. No.: 239,898

[22] Filed: Mar. 3, 1981

[51] Int. Cl.[3] ..... B28B 17/00

[52] U.S. Cl. ..... 425/195; 425/346; 425/357; 425/411; 425/414

[58] Field of Search ..... 425/195, 346, 357, 411, 425/414

[56] References Cited

U.S. PATENT DOCUMENTS

| | | | |
|---|---|---|---|
| 1,838,518 | 12/1931 | Anderson | 425/195 |
| 3,447,205 | 6/1969 | Dorsey | 425/195 |
| 4,265,610 | 5/1981 | Dorsey | 425/411 |

FOREIGN PATENT DOCUMENTS

| | | | |
|---|---|---|---|
| 51-53556 | 5/1976 | Japan | 425/195 |

*Primary Examiner*—John A. Parrish
*Attorney, Agent, or Firm*—Nelson E. Kimmelman

[57] ABSTRACT

In presses such as hydraulic presses used for forming tiles or bricks from ceramic or other materials, a mold box is mounted in alignment with the upper and lower dies. To hold the mold box without keying it to the mold case, a wedging assembly comprises an outer wedge releasably fixed to a wall of the opening and having a vertically angled surface facing inwardly. Next to it is an inner wedge having a vertically angled surface which is brought into contact with the angled surface of the outer wedge. Adjustable securing means such as vertical bolts pass through a vertical passageway in the inner wedge and are screwed into an aligned, threaded passageway in the outer wedge for moving the inner wedge vertically until its translation laterally secures the key-less mold box fast by friction alone against downward thrusts of the upper die.

14 Claims, 6 Drawing Figures

FIG. 2
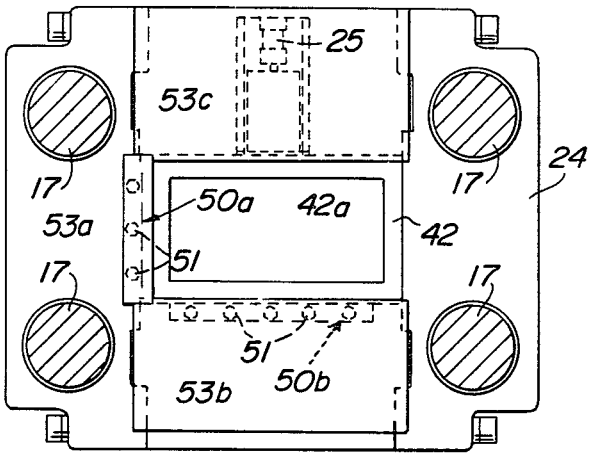
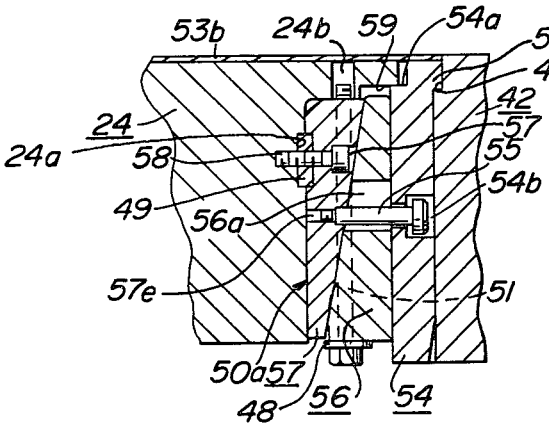
FIG. 3

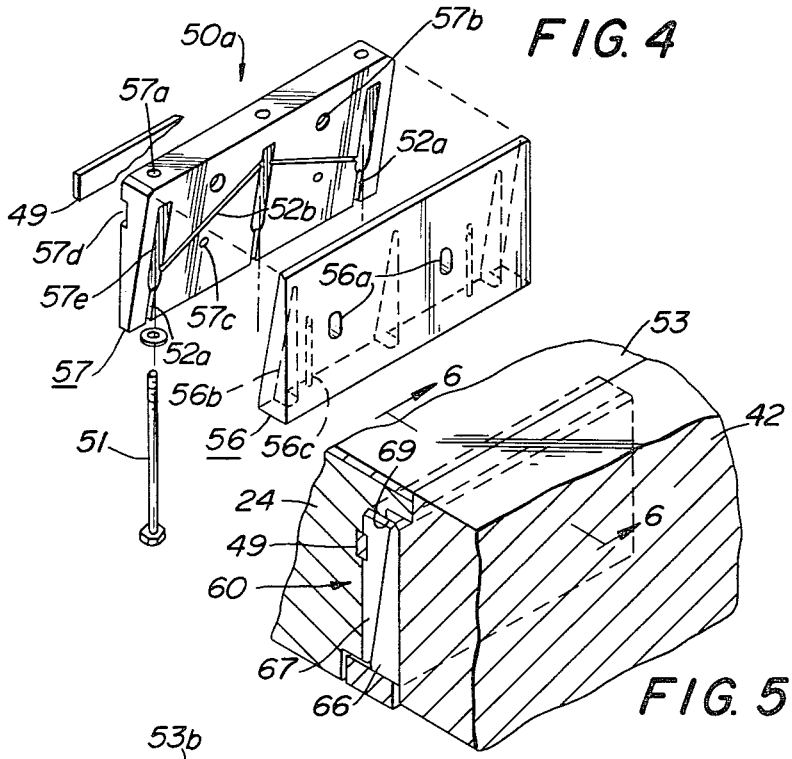
FIG. 4
FIG. 5
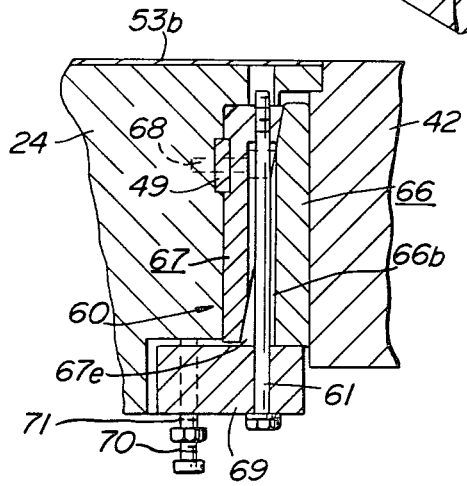
FIG. 6

MOLD BOX WEDGING ASSEMBLY

BACKGROUND OF THE INVENTION

1. Field of the Invention

This invention relates to mold box retaining means and especially to mold box retaining assemblies for use in hydraulic presses which compress powdered ceramic materials or the like.

2. Prior Art

In the mechanical or hydraulic press art, there usually is a mold case to which a mold box is secured. The mold box has a central cavity into which the top die or plunger and the bottom die or plunger moves and which cooperates therewith to form under high pressure a tile or brick. The mold box took various forms. One common form had four parts, a fixed rear beam, a front beam, and two intermediate transverse side beams with bolts passing inwardly through the front and rear beams to threaded passageways in the side beams. Some of the outer walls of the beams had projecting keys which mated with corresponding channels in the mold case. Such keys, of course, required considerable machining. Furthermore, by the nature of their construction, removal of at least one of the beams was required to enable the lower die to be inserted horizontally. Removal of the beam or beams required removal of numerous bolts which was not only time-consuming but also difficult and awkward. When such mold boxes were assembled to the mold case and subjected to extremely high pressures by the downward movement of the upper ram-die assembly, the intense vertical pressure acting upon the powdered material in the mold cavity produced a correspondingly intense outward pressure exerted on the inner walls of the mold box. The pressure was such as to cause those inner walls to be pushed outwardly and to deform the bolts resulting in the loss of the requisite geometric integrity in the mold cavity for production of first-grade tiles or bricks or the like. When this happened, the necessary small tolerances in the mold cavity could not be maintained and the useful life of the mold box was considerably shortened. So-called "fins" appeared on the pressed product caused by the yielding walls of the mold box and these fins were not commercially acceptable. If the actual mold box cavity tolerances departed unacceptably from the desired tolerances, the mold box would become mutilated and unusable and the fabrication of new mold boxes would require considerable additional expense.

Other approaches to fastening a mold box in a mold case have involved the use of a special plate with a number of discontinuities which are curved and with which a corresponding number of curved wedges are used. Such a structure is shown in U.S. Pat. No. 3,447,205. It is clear that that is a highly complex assembly which requires extensive machining or special forming and, in any event, also has a mold box-wedge relation which requires the use of a key.

It is therefore among the objects of the present invention to provide a novel wedging assembly for fastening mold boxes or the like in a key-less frictional arrangement, which permits vertical withdrawal of the mold box in a much more accessible, time-saving fashion.

BRIEF SUMMARY OF THE INVENTION

A wedging assembly comprising an outer wedge adapted to be fixed to a wall of an opening, the outer wedge having a vertically angled surface facing inwardly and an inner wedge having a vertically angled surface disposed in contact with the angled surface of the outer wedge, the inner wedge being arranged for adjustment to a predetermined vertical position by adjustable securing means passing vertically through a passageway in said inner wedge and engaging an aligned passageway in the outer wedge.

BRIEF DESCRIPTION OF THE DRAWINGS

FIG. 2 is an enlarged sectional view of a correspondingly designated section of the apparatus shown in FIG. 1;

FIG. 3 is an enlarged, fragmentary sectional view of the portion of apparatus shown in the broken-line oval in FIG. 1;

FIG. 4 is an exploded, isometric view of the main components of the wedge assembly shown in FIG. 3;

FIG. 5 is an isometric view, partly in section, of another embodiment of the wedge assembly according to the present invention; and FIG. 6 is a sectional view taken along the section lines 6—6 in FIG. 5.

DETAILED DESCRIPTION OF THE DRAWINGS

Figure 1:
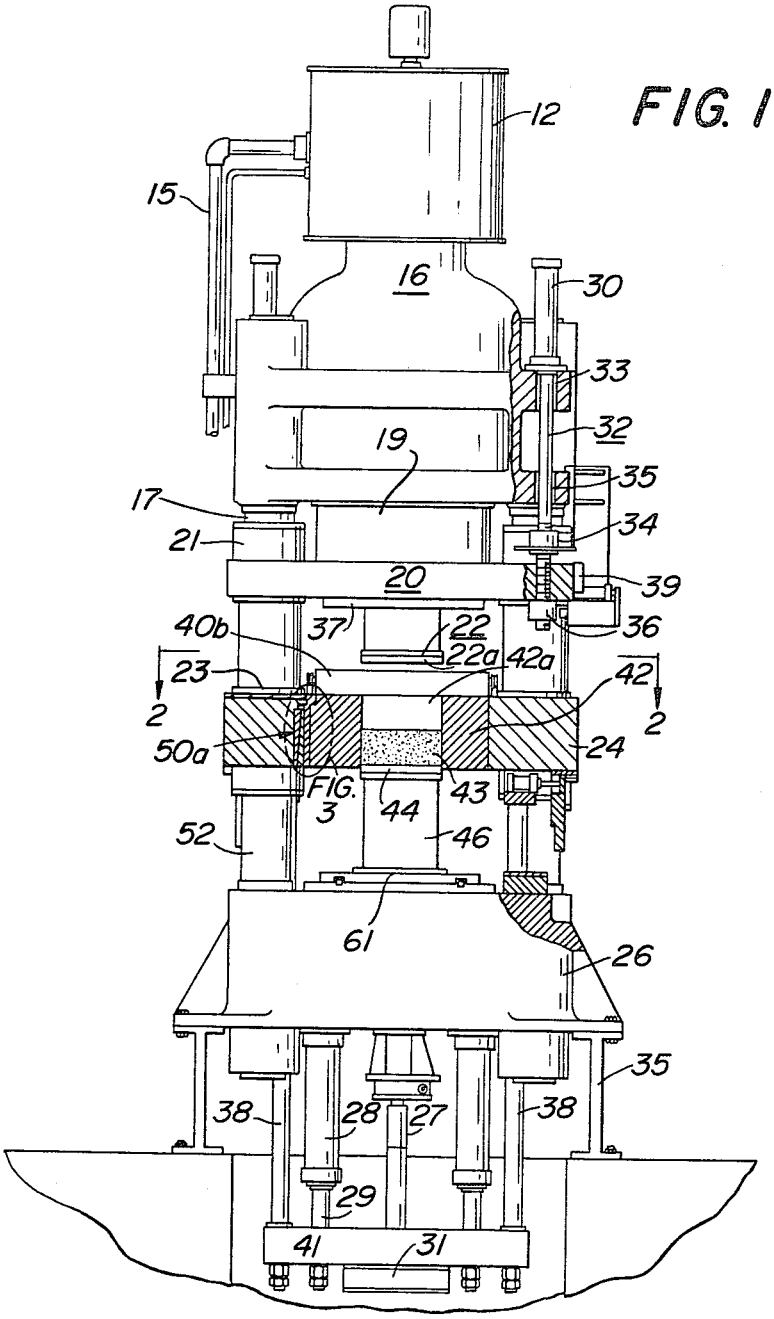
FIG. 1 is a side elevation view, partly in section, of a hydraulic press or the like in accordance with the present invention showing within the broken-line oval designated "FIG. 3" the novel wedge assembly in accordance with the present invention.

Referring to FIG. 1, a hydraulic press is shown generally at the numeral 10 which is a typical environment for the present invention. Although the present invention is concerned with the means for retaining the mold box 42 in the mold case 24, the rest of the structure will be briefly described first.

The press has at its top a surge tank 21 for hydraulic fluid from which hydraulic lines 14 and 15 extend to a hydraulic control panel (not shown). It has a main press head 16 which is a single casting through which the upper ends of shafts or columns 17 extend. This casting incorporates a cylinder for the hydraulic fluid that drives the piston 19 which is bolted or otherwise connected to the main ram 20.

Piston rods 32 attached to pistons in jack cylinders 30 pass through aligned apertures 33 and 35 in the head 16. A vertically movable main ram 20 has apertures through which the lower, threaded ends of rods 32 pass. Ram 20 is cast integrally with bearings 21 surrounding shafts 17 and has a lower plate 37. Lower nuts 36 are screwed onto the lower ends of the rods 32 and the ram rests solely by gravity on the nuts throughout most of its descent as it approaches the mold cavity 42*a*.

Also attached to the main ram 20 and depending therefrom is an upper die holder to whose lower surface an upper die 22*a* is attached which is so dimensioned as to move snugly into the die cavity 42*a* formed within the mold box 42. The mold box 42 is made of one piece and is maintained in position within the mold case 24 by novel wedge assemblies 50*a* and 50*b* (FIG. 2) as will be explained below. Case 24 is also movable vertically, its bearings 24*a* engaging the column 17. The mold case 24 is supported on rods 38 which pass through holes in the press bed 26 which rests on I-beams 35. The lower ends of rods 38 are attached to a slab 41. Piston rods 29 extending downwardly from cylinders 28 fixed to the underside of the bed 26 are constructed to raise or lower the slab 41 which, in turn, raises or lowers the rods to which the mold case 24 is attached at their upper ends.

There is also a stationary lower mold assembly comprising a lower mold support 46 which rests upon the top horizontal surface of the bed 26. At the upper end of the support 46, the lower die member 44 is affixed. The member 44 has a cross-section which is substantially congruous with the cross-section of the mold-cavity 42*a* so that when ceramic material 43 is placed in the cavity, it cannot escape downward past the lower die.

An automatically reciprocated feed box 40*b* is connected to move over the mold box 42 to empty ceramic "dust" 43 into the cavity 42*a*. Hydraulically operated apparatus shown generally at 61 is constructed to move the lower die assembly 46 laterally when dies are to be changed.

Hydraulic presses such as the one shown in FIG. 1 are manufactured and sold by Crossley Machine Company, Inc. of Trenton, N.J. and are capable of producing very high downward pressures on the ceramic dust. After the hydraulic system has been actuated, the ram-die assembly is moved down by piston 9 to exert extremely high pressure on the dust, e.g., 3800 lbs. per square inch. Under such pressures, as has been previously explained, extremely high lateral pressure is placed upon the interior walls of the mold box 42. To resist the deleterious effects of this intense pressure, and to enable much quicker changes of dies, the wedge assembly 50*a* shown within the broken line oval designated FIG. 3 is designed, according to the present invention, to overcome prior art disadvantages and attain those objectives.

Referring now to FIGS. 1, 2, 3 and 4, there is provided a key-less wedging mechanism 50*a*, indicated within the broken line oval of FIG. 1 and also shown in FIGS. 2, 3 and 4. This mechanism locks a one-piece mold box within the mold case 24 in such a way that it will withstand the tremendous pressure exerted by the ram 20 and the upper die 22. Furthermore, its construction enables the mold box to be fitted within the mold case 24 from below. Its simplicity enables the insertion or removal time of the mold box to be cut from say, a conventional 5 hour period to one and one-half hours. This results in higher productivity because of less "down time."

Two wedge assemblies are used to hold the mold box 42. Only one of them, wedge assembly 50*a*, is fully shown in FIGS. 1, 3 and 4. It is the one positioned on one side of the mold box, but, in fact, another one 50*b* (FIG. 2) is also installed in the front wall portion which would be on the left if the press were viewed from the right. The two wedge assemblies are essentially identical except that, if one side of the mold box is longer as shown in FIG. 2, it would have a correspondingly longer wedge and would require more horizontal and vertical bolts and passageways to install it and fix it in its final position.

A downwardly and outwardly tapering wedge 57 is fastened by machine screws 58 which pass through holes 57*b* into threaded apertures formed in case 24. These screws also pass through apertures (not shown) in a key 49 disposed in a horizontal channel defined by facing horizontal grooves 24*a* and 57*d* formed in the mold case 24 and wedge 57, respectively. An upwardly tapering wedge 56 having vertical slots 56*a* is movable essentially vertically with respect to wedge 57 thereby changing the horizontal location of its untapered vertical surface.

The two angled surfaces of wedges 56 and 57 are brought into contact with one another so that the hollowed-out, partially conical portions 56*b* in wedge 56 face respective hollowed-out portions 57*e* in wedge 57. Smaller, partially tubular vertical grooves 52*a* lead from the bottom of wedge 57 to portions 57*e*. Similar, partially-tubular, angled grooves or passageways 52*b* connect portions 57*e* with one another. Vertical inlet grease passageways 56*c* are formed in wedge 56 having upper terminal openings in the inclined surfaces of wedge 56.

Vertical bolts 51 have associated washers 48 and pass upwardly, first through hollowed-out portions 56*b* in the movable inner wedge 56, then through hollowed-out portions 57*e* in wedge 57, then through vertical threaded apertures 57*a* communicating with portions 57*e* and finally into the hole 24*b* in mold case 24.

As may be seen from FIGS. 1 and 3, a spacer plate or member 54 having an upper shoulder 54*a* and a projecting ledge 54*c* is also assembled to the wedge assembly 50*a* in this form of the invention. It has counterbored apertures 54*b* drilled horizontally through which, via slots 56*a*, shoulder bolts 55 pass. Bolts 55 also pass through slots 56*a* and terminate with their threaded ends screwed into threaded apertures 57*e* in the fixed outer wedge 57. These spacer members 54 are not essential in all forms of the wedge assembly invention, but are useful to enable a standard press to accommodate mold boxes of different outer dimensions.

Shown in FIG. 2 from above are three dust-protective and/or wear plates 53*a*, 53*b* and 53*c*. Plates 53*b* and 53*c* are inset onto the top of the press bed opposite one another. Plate 53*a* is placed on one short side covering the wedge assembly 50*a* and is in the path of the reciprocating dust box (FIG. 1, 40*b*) which fills the mold cavity 42*a* with ceramic material 43 at the beginning of each cycle of operation. Since ceramic dust is abrasive and consists of very fine particles, plate 53*a* is a replaceable member made of abrasion-resistant steel that enables the top of the mold case 24 to be kept level with the top of the mold box 42. It also helps keep the dust from infiltrating downward into the spaces in wedge assembly 50*a*. Plates 53*b* and 53*c* are disposed along the long front and back sides of the mold case 24, the plate 53*c* serving only a wear-protection function. Plate 53*b* is also abrasion-resistant, but serves additionally to prevent dust infiltration downward into wedge assembly 50*b* below it.

As stated above, before the mold box-lower die installation is made, the mold case 24 is in an upper position and wedge assemblies 50*a* and 50*b* are partially in place in it. That is to say, the outer wedges 57 are fixed in place by bolts 58 screwed through key 49 into mold case 24. The inner, movable wedge 56 is suspended by the horizontal bolt 55 which also passes through and retains the spacer 54 loosely since the shoulder bolt 55, when screwed in completely, leaves a slight space between its head and the counterbored hole 54*b*.

The mold box 42 is raised from below until its shoulder 42*b* engages the projection 54*c* of the spacer 54 as shown in FIG. 3. It is then maintained in place vertically by inserting a number of blocks of the proper total height below it, but clear of the mold box cavity 42*a*.

The lower die 44 is on the support or pedestal member 46 and is bolted to the slider mechanism 60. The slider 60 is then actuated to move 44, 46 from a side surface which is at the same height as the top surface of the bed 26 toward the vertical center line of the press until it is in vertical alignment with the space defined by the mold cavity formed by the mold box 42. Then the mold case 24 is lowered until the top of the lower die 44 is flush with the bottom of the mold case. The wedge assemblies are then tightened by screwing the bolts 51 further in thereby lifting the inner wedges 56, the angled surfaces of wedges 56 and 57 sliding with relative ease against one another because of the lubrication by grease in the grease channels. This vertical movement of wedges 56 translates into horizontal movement inwardly against the spacer 54 which thereupon slides to the right as seen in FIG. 3. Shoulder 54*a* remains in intimate sliding contact with the undersurface 59 of the mold case projection. Further screwing of the bolts 56 continues until horizontal pressure by both wedge assemblies against the mold box is strong enough to enable the box to resist the tremendous downward pressure exerted by the upper die 22 against the dust 43 in the mold box cavity 42*a*.

When it is desired to remove the old die, the mold case is lowered, the wedge bolts are loosened, then the mold case is raised until the mold box is released from the wedge assemblies. Then the mold case is lowered and the ram-die assembly 20, 22 is raised. Then the mold case is raised to complete the hydraulic cylinder stroke. Then the lower die is moved out of position by the mechanism 60 and taken off by a fork lift truck, for example.

While the wedge assembly as illustrated in FIGS. 1, 3 and 4 consisted of two angled wedges and a spacer, the form of the invention shown in FIGS. 5 and 6 is somewhat different. There the spacer is dispensed with and a different way of exerting upward pressure on the inner wedge and retaining it in place is employed. As shown in FIG. 6, the wear plates, mold case, horizontal keys and outer and inner wedges, here numbered 67 and 66 respectively, are used. The outer wedge 67 is fixed to the mold case 24 by horizontal bolts 68 passing through holes in key 49 and screwed into the mold case. However, the inner wedge 66 does not have slots such as slots 56*a* in the previous embodiment because there is no corresponding horizontal shoulder bolt 55 passing through it and a spacer. Accordingly, there is no horizontal threaded aperture in the outer fixed wedge 57 to engage its threaded terminal portion. Instead there is a bottom horizontal bar which is bolted to the case 24 by vertical safety bolts 70 which prevent the assembly falling out. Jack bolts 71, spaced from but aligned with bolts 70 are screwed through a threaded hole in bar 69 until their upper ends touch the case 24. They enable the inner wedge to be lowered if desired. Long vertical bolts 61 pass upward through bar 69, through the ground-out portion 66*b* of the inner wedge and into a vertical threaded aperture in the upper part of outer wedge 67. Grease channels such as the ones shown above could be employed similarly.

In some instances an even simpler form of the wedge assembly could be employed which utilizes neither a spacer nor a lower retaining bar. In this form, the outer wedge would be shaped the same as or similar to the outer wedge 67 and would be fastened similarly. The inner wedge would also be the same as or similar to wedges 66. Bolts similar to, but shorter than bolts 61 would be similarly screwed upward from the bottom of the inner wedge. They would use large washers dimensioned to be wider than the transverse cross-section of the hollowed or ground-out portions (such as 66*b*) at their lower ends. The lubrication system for the contacting faces of the wedges could be as shown above.

What is claimed is:

1. A wedging assembly for demountably fixing a mold box or the like within an opening in a surrounding casing member, comprising:

(a) an outer wedge adapted to be fixed to one wall of said opening, said outer wedge having a vertically angled surface facing inwardly, and (b) an inner wedge disposed with a vertically angled outward surface in contact with said angled surface of said outer wedge, said inner wedge being arranged for adjustment to a predetermined vertical position, said inner and outer wedges each having at least one substantially vertical passageway capable of at least partial alignment, and (c) adjustable securing means passing through said vertical passageway in said inner wedge and engaging said vertical passageway of said outer wedge for limiting movement of said inner wedge downward beyond a predetermined point and for moving said inner wedge vertically.

2. The wedging assembly according to claim 1 wherein said outer wedge has a first plurality of transverse apertures formed therein, said first apertures being aligned with a corresponding second plurality of apertures in said casing member which are threaded, wherein first horizontal bolts are passed through said first plurality of apertures to engage the corresponding second plurality of apertures in said casing, wherein said inner wedge and said outer wedge have respective third and fourth pluralities of aligned transverse apertures formed therein, and wherein second horizontal bolts are passed through said third plurality of apertures and are screwed into the corresponding fourth plurality of apertures which are threaded.

3. The wedging assembly according to claim 2 with the addition of a vertical, essentially planar plate mounted adjacent to and inwardly of said inner wedge and having a fifth plurality of transverse apertures formed therein aligned with said third plurality of apertures in said inner wedge, said second plurality of horizontal bolts respectively passing through said fifth and third pluralities of apertures and being screwed into said fourth plurality of apertures.

4. The wedging assembly according to claim 2 wherein said adjustable securing means includes a plurality of vertical bolts which pass through said substantially vertical passageways in said inner and outer wedges and wherein said surrounding casing includes vertical apertures formed therein coaxial with and adjacent to said substantially vertical passageways in said outer wedge through which the upper ends of said bolts may pass.

5. The wedging assembly according to claim 2 wherein said third transverse apertures are elongated in a vertical direction to permit passage of said second horizontal bolts therethrough despite adjustments of said inner wedge within predetermined limits in a vertical direction.

6. The wedging assembly according to claim 3 wherein said fifth plurality of transverse apertures formed in said plate are counterbored to enable the heads of said second plurality of horizontal bolts to be totally outwardly of the inner surface of said plate.

7. The wedging assembly according to claim 3 wherein said plate has an upper, outer shoulder and said casing has an upper projecting ledge which engages said shoulder and limits the uppermost position of said plate, the lower surface of said projection being arranged for sliding contact with said shoulder.

8. The wedging assembly according to claim 1 wherein the contacting angled surfaces of said inner outer wedges are provided with indentations to which lubricating means are to be supplied thereby reducing friction between said surfaces when said adjustable securing means moves said inner wedge vertically.

9. The wedging assembly according to claim 8 wherein said indentations comprise a plurality of spaced and interconnected groove-like channels formed in said outer wedge.

10. The wedging assembly according to claim 8 wherein said inner wedge is provided with substantially vertical passageways which terminate in openings on the angled surface of said inner wedge.

11. The wedging assembly according to claim 1 wherein the vertical passageways in said outer wedge are at least partially threaded and wherein said adjustable securing means comprise a plurality of bolts which are screwed into said partially threaded passageways.

12. The wedging assembly according to claim 1 wherein said outer wedge is provided with a horizontal channel, wherein the portion of said casing opposite said channel is also provided with a horizontal channel facing said first-named channel, and wherein key means are provided for disposition within the key-way formed by said facing channels.

13. The wedging assembly according to claim 1 with the addition of retaining means disposed below both of said wedges and having an outer portion thereof adapted to be fixed to said casing and wherein said adjustable securing means comprise a plurality of vertical bolts which pass through said retaining means and are screwed into said vertical passageway in said outer wedge, adjustment of said bolts providing adjustment of the vertical position of said retaining means and thereby adjustment of the vertical position of said inner wedge.

14. A wedging assembly for demountably fixing a mold box or the like within an opening in a surrounding casing member, comprising:

(a) an outer wedge adapted to be fixed to one wall of said opening, said outer wedge having a vertically angled surface facing inwardly, (b) an inner wedge disposed with a vertically angled outward surface in contact with said angled surface of said outer wedge, said inner wedge having a horizontal aperture formed therein, (c) horizontal securing means which is dimensioned and arranged to pass through said aperture with ample clearance and which has one end fixed to said outer wedge, and (d) vertically adjustable securing means passing through both of said wedges for imparting vertical movement to said inner wedge thereby causing the latter to be moved laterally inward or outward.

* * * * *